United States Patent [19]

Godar et al.

[11] 4,116,812

[45] Sep. 26, 1978

[54] ORGANO-SULFUR COMPOUNDS AS HIGH TEMPERATURE ANTIFOULANTS

[75] Inventors: Richard L. Godar; Philip R. Corneli, both of St. Louis, Mo.

[73] Assignee: Petrolite Corporation, St. Louis, Mo.

[21] Appl. No.: 813,193

[22] Filed: Jul. 5, 1977

[51] Int. Cl.[2] ..... C10G 9/16; C08K 5/36; C10C 7/18

[52] U.S. Cl. ..... 208/48 AA; 203/8; 203/58; 208/106; 208/264; 252/45; 252/77; 252/406; 260/45.7 S; 260/327 C

[58] Field of Search ..... 208/48 AA; 260/666.5, 260/327 C

[56] References Cited

U.S. PATENT DOCUMENTS

| | | | |
|---|---|---|---|
| 2,129,693 | 9/1938 | Houdry | 208/119 |
| 3,197,396 | 7/1965 | Stedman | 208/189 |
| 3,407,240 | 10/1968 | Sakashita et al. | 260/666.5 |

*Primary Examiner*—Delbert E. Gantz
*Assistant Examiner*—G. E. Schmitkons
*Attorney, Agent, or Firm*—Sidney B. Ring; Hyman F. Glass

[57] ABSTRACT

This invention relates to a process of inhibiting or preventing fouling (i.e., preventing the adhesion of deposits from hydrocarbon on surfaces) at elevated temperatures which comprises adding to hydrocarbon an antifouling (preventing) amount of an organo-sulfur compounds having a high sulfur content. In the preferred embodiment, the organo-sulfur compound has at least 5% sulfur. An embodiment is a heterocyclic compound, a dithiole-thione. These organo sulfur compounds are particularly effective at elevated temperatures of at least about 500° F.

5 Claims, No Drawings

ORGANO-SULFUR COMPOUNDS AS HIGH TEMPERATURE ANTIFOULANTS

This invention relates to a method of chemically treating hydrocarbon liquids which contact surfaces under high temperature conditions in order to inhibit, prevent and/or reduce the deposition of substances thereon. More specifically, this invention relates to the chemical treatment of the metal surfaces in contact with petroleum hydrocarbon liquids under conditions of high temperature whereby said liquids tend to form deposits on such metal surfaces. This invention also relates to compositions employed in these processes.

In the processing of hydrocarbon liquids, particularly petroleum hydrocarbon liquids, elevated temperatures are often used in many necessary and important operations. To handle liquids at elevated temperatures, heat exchangers and the like devices are often employed to control the heat transfer rate from one operational step to another. When hydrocarbon liquids contact hot metal surfaces, there is sometimes a tendency for the liquid to decompose or undergo a chemical reaction that manifests itself in the form of deposits. These deposits may be either coke-like or they may be in the form of tenacious, soft, sticky sludges which adhere to hot surfaces. Adherences of deposits, rather than deposit-formation itself, is the essence of the problem, in contract to fuel storage where residue in the oil itself creates the problem.

The problem is well recognized in the art — note "Petroleum Products Handbook," Guthrie (McGraw-Hill, 1960) pp. 1–13, U.S. Pat. No. 2,908,824 and elsewhere.

These deposits tend to materially decrease the heat transfer capacities of the metal surfaces and hence increase operating expenses. These deposits also require additional effort and time to remove and to restore the equipment to its original operating efficiency.

Petroleum refinery operations often encounter the above described conditions in many stages in the refining process. These deposits form on heat transfer surfaces at temperatures for example such as about 150°–225° F. and may be evidenced at temperatures as extreme as 1000° F. or higher.

It is practically impossible to prevent these deposits by coating the metal surfaces with a protective permanent coating due to the possible loss of heat transfer. In addition, the large volume of liquid that contacts such equipment increases the problem of treating metal surfaces in petroleum processing to prevent high temperature deposits.

It would be advantageous to add a chemical agent in extremely small amounts to a hydrocarbon liquid which tends to form high temperature deposits whereby such deposits would be inhibited or prevented. It would also be desirable if such a chemical would not only prevent such deposits but would also remove them without necessitating the stoppage of a given operation. It therefore becomes an object of the present invention to prevent the formation of high temperature deposits on metal surfaces by chemical means.

Another object is to furnish a chemical which when added to a hydrocarbon liquid will prevent the deposit-forming tendencies of said liquid when it contacts metal surfaces at elevated temperatures.

A further object is to provide a chemical treatment which will prevent the formation of high temperature deposits by petroleum hydrocarbon liquids in contact with heat transfer equipment.

Yet another object is to furnish a chemical treatment capable of being combined with a thermally unstable, deposit-forming liquid whereby said liquid will not form deposits upon metal surfaces at elevated temperatures.

Still another object is to provide a chemical treatment which will remove high temperature deposits from metal surfaces of petroleum refining equipment without the necessity of stopping the operations of such equipment. Other objects will appear hereinafter.

We have now discovered a process of preventing, inhibiting and/or reducing the formation of surface deposits from petroleum hydrocarbon liquids during the processing thereof at elevated temperatures such as from about 500°–1,500° F. (i.e., the adhesion of deposits to heat exchange metal surfaces) by adding to the hydrocarbon liquid such as by solution and/or dispersion an anti-fouling amount of the organo-sulfur compositions of this invention.

The anti-fouling additive system of this invention can be employed in refining crude petroleum as well as in the treatment of any component thereof which are exposed to high temperatures including the light distillates, for example light naphthas, intermediate naphthas, heavy naphthas, etc.; middle distillates, for example kerosene, gas, oil, etc.; distillate lube oil stocks for example, white oil, saturating oil, light lube oil, medium lube oil, heavy lube oil, and the like.

The amount of anti-fouling agent required in this invention is subject to wide variation but in general very effective results have been obtained by adding relatively minute amounts of the anti-fouling agent to the hydrocarbon liquid being processed, for example, amounts may be as low as 0.5 p.p.m. in hydrocarbon liquid, for example 1 to 500 p.p.m. In general, the upper limit is determined by the economics of the process but other factors should be taken into consideration, such as whether large amounts will have any adverse effects on present or subsequent operations. Because of the many different types of operatios where hydrocarbons are heated to elevated temperatures under conditions where deposits are formed, it is difficult to give specific ranges which will be effective in all operations. The amount of agent which inhibits the formation of deposits is referred to herein as an "anti-fouling amount." The above figures relate to p.p.m. in terms of active anti-fouling chemical not including the solvent employed.

Inasmuch as the anti-fouling agent is employed in such small amounts and it is preferable to feed them continuously or semi-continuously by means of a proportioning pump or other suitable device to the particular hydrocarbon liquid being processed or to add them in a similar manner to the apparatus in which the hydrocarbon liquid is being processed, it is desirable to incorporate the agent or a mixture of agents into a suitable solvent which will be compatible with the liquid which is to be processed. The solvent which is used to dissolve the active ingredient is also subject to some variation depending upon the solubility characteristics of the particular compound employed. In some cases, even though the active mixture is insoluble in a particular solvent, it will dissolve in a combination of solvents.

In the practice of the invention it is very desirable to start the treatment with the chemicals employed for the purpose of the invention at a higher dosage and the gradually reduce the dosage to the point where fouling of the apparatus is just eliminated.

The organo-sulfur compositions of this invention have a high sulfur content. In general, the sulfur content is from about 5 to 60% or more, such as from about 10 to 55%, for example from about 20 to 50%, but preferably from about 25 to 45%.

An embodiment of organo-sulfur compositions of high sulfur content includes heterocyclic compounds, an example of which comprises dithiole-thiones as illustrated by 1,2-dithiole-3-thiones.

1,2-dithiole-3-thiones are known compounds prepared by a variety of methods. Examples of such compounds, and methods for their preparation, are disclosed in THE CHEMISTRY OF HETEROCYCLIC COMPOUNDS, "Multi-Sulfur and Sulfur and Oxygen Five-and Six-Membered Heterocycles," PART 1, pages 237–386, by David S. Breslow et al., Interscience Publishers, 1966.

1,2-dithiole-3-thiones may be expressed by the formula:

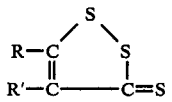

where R and R′ are substituted groups, for example, alkyl, aryl, cycloalkyl, alkenyl, alkynyl, alkaryl, aralkyl, heterocyclic, etc. In addition, one of the above R's may be hydrogen. Examples of a wide variety of 1,2-dithiole-3-thiones are presented in the above text by Breslow et al in Table 4, pages 352–366, which is incorporated into this application as if part hereof.

1,2-dithiole-3-thiones are conveniently prepared by the classic method of reacting an olefin with sulfur, for example, according to the following equation:

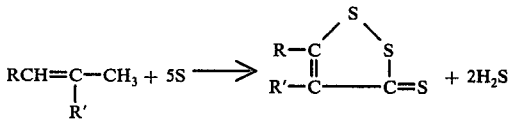

The olefin employed in the reaction contains 1. a reactive double bond
2. a primary carbon atom
3. at least four hydrogen atoms on the 3 terminal carbons with at least one hydrogen on the carbon beta to primary carbon atom.

This reaction is carried out at any suitable temperature and time, for example, at about 100° to 300° C., such as from about 140° to 240° C. but preferably from about 160° to 220° C. for a period of about 2 to 160 hours, and about 10 to 50 hours, but preferably about 15 to 40 hours.

The following examples are presented by way of illustration and not of limitation to show the preparation of 1,2-dithiole-3-thiones.

EXAMPLE 1A: The Preparation of 4-phenyl-1,2-dithiole-3-thione

In a suitable reactor equipped with a stirrer, thermometer and a reflux condenser, was placed 118 g of methylstyrene and 48 g of sulfur. The mixture was heated for 37 hours at 200°–210° C. After the reaction was completed, the mixture was slowly cooled to room temperature. The product was collected and crystallized from benzene, red crystals, (32 grams, 50% yield), m.p. 122°–124° C.

EXAMPLE 2A: Preparation of 4-(3-methoxy-4-hydroxy)phenyl-1,2-dithiole-3-thione In a suitable reactor equipped with a stirrer, thermometer, addition funnel and reflux condenser was placed, 32 g of sulfur, 1.0 g of di-o-tolylguanidine as catalyst and 150 cc of mesitylene as solvent. The mixture was brought to a reflux (170° C.) and over a 1 hour period 66 g of isocugenol

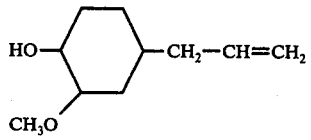

was added dropwise. Reflux was continued for 48 more hours. The mesitylene was decanted from the solid. The solid was treated twice with 500 cc portion of a 5% aqueous potassium hydroxide solution. Upon acidification the product precipitated as a brown solid.

EXAMPLE 3A: Preparation of 4-neopentyl-5-t-butyl-1,2-dithiole-3-thione

To a mixture of 320 g of sulfur and 6.0 g of di-o-tolylguanidine was added over a 9 hour period, at a reaction temperature of 210°–215° C., 336 g of triisobutylene, mainly

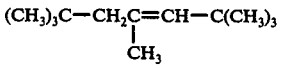

Heating at 210°–215° C. was continued for an additional 14 hours. The product was distilled and there was collected 220 g of 4-neopentyl-5-t-butyl-1,2-dithiole-3-thione, b.p. 155°–185° C. (3–4 mm Hg).

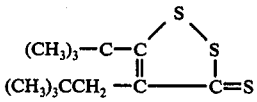

EXAMPLE 4A: Preparation of 4,5-tetramethylene-1,2-dithiole-3-thione

In a suitable reactor equipped with a stirrer, reflux condenser, thermometer and addition funnel was placed 24 g. of sulfur, 171 g of carbon disulfide and 150 cc of dimethyl formamide. The mixture was cooled to 0° C. and under continuous stirring and cooling 132 g. of 1-morpholino-1-cyclohexene was introduced over a ½ hour period. After the addition was completed, stirring was continued for an additional 16 hrs. The resulting slurry was poured into water and the resulting orange solid crystallization from acetone, m.p. 95°–97° C. Yield 37%.

The following Table presents illustrative 1,2-dithiole-3-thiones of the formula

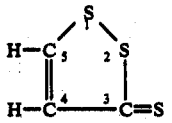

The radical indicated replaces the H's in the 4th and/or 5th positions as indicated.

TABLE I 1) 4-$CH_3$
2) 5-$CH_3$—
3) 4-$C_2H_5$—
4) 5-$C_2H_5$—
5) 4-$(CH_3)_3CCH_2$—
6) 5-$_n$-$C_{17}H_{35}$—
7) 4-$C_6H_5$—
8) 5-$C_6H_5$—
9) 4-(p-$CH_3C_6H_4$—)
10) 5-(p-$CH_3C_6H_4$—)
11) 4-(p-$C_2H_5C_6H_4$—)
12) 4-(p-t-$C_4H_9C_6H_4$—)
13) 4-(p-t-$C_6H_{11}C_6H_4$—)
14) 5-(p-$C_6H_5$-$C_6H_4$—)
15) 5-(p-$ClC_6H_4$—)
16) 5-(p-$BrC_6H_4$—)
17) 5-(p-$IC_6H_4$—)
18) 4-(p-$CH_3OC_6H_4$—)
19) 5-(o-$CH_3OC_6H_4$—)
20) 5-(p-$CH_3CC_6H_4$—)
21) 5-(p-$HOC_6H_4$—)
22) 5-(p-$CH_3CO_2C_6H_4$—)
23) 5-[p-$(CH_3)_2NC_6H_4$—]
24) 5-[2,4-$(CH_3)_2C_6H_3$—]
25) 5-(2-$CH_3O$-5-$CH_3C_6H_3$—)
26) 5-[2,3-$(CH_3O)_2C_6H_3$—]
27) 5-[2,5-$(CH_3O)_2C_6H_3$—]
28) 5-[3,4-$(CH_3O)_2C_6H_3$—]
29) 5-(3-$CH_3O$-4-$HOC_6H_3$)
30) 5-(2-HO-3-$CH_3OC_6H_3$—)
31) 5-(3-$CH_3O$-4-$CH_3O_2CCH_2OC_6H_3$—)
32) 5-[3,4-$(HO)_2C_6H_3$—]
33) 5-[3,4-$(CH_3CO_2)_2C_6H_3$—]
34) 5-(3,4-Methylenedioxyphenyl-)
35) 5-(3,4,5-$I_3C_6H_2$—)
36) 4-(1-Naphthyl-)
37) 4-(1-Naphthyl-)
38)

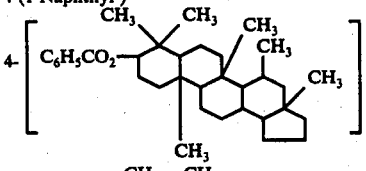

39)

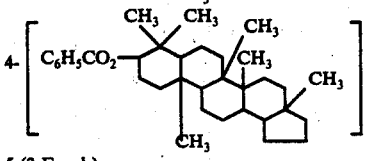

40) 5-(2-Furyl-)
41) 4-(2-Thienyl-)
42) 5-(2-Thienyl-)
43) 4-(4-$CH_3$-2-thienyl-)
44) 5-(5-$CH_3$-2-thienyl-)
45) 5-(5-$C_2H_5$-2-thienyl-)
46) 4-[3,4-$(CH_3)_2$-2-thienyl-]
47) 5-(2-Pyridyl-)
48) 5-(3-Pyridyl-)
49) 5-(4-Pyridyl-)
50) 5-($C_6H_5CH$=CH—)
51) 5-(p-$CH_3OC_6H_4CH$=CH—)
52) 5-(2-Furyl-CH=CH—)
53) 5-[p-$(CH_3)_2HC_6H_4N$=CH—]
54) 5-[p-$(CH_3)_2NC_6H_4N$=CH—]
55) 5-$C_2H_5OOC$
56) 5-HOOC—
57) 4,5-$(CH_3—)_2$
58) 4-$CH_3$-5-$C_2H_5$—
59) 4-$C_2H_5—)_2$
60) 4,5-$(C_2H_5—)_2$
61) 4-(n-$C_3H_7$—)-5-$CH_3$—
62) 4-(n-$C_4H_9$—)-5-$CH_3$—
63) 4-$CH_3$-5-(t-$C_4H_9$—)
64) 4-$(CH_3)_3CCH_2$-5-(t-$C_4H_9$—)
65) 4-[$(C_2H_5)_2NCH_2CH_2$—]-5-$CH_3$ . $HClO_4$
66) 4-[$(C_2H_5)_2NCH_2CH_2$—]-5-$CH_3$ . HCl
67) 4-$C_6H_4CH_2$-5-$CH_3$—

TABLE I-continued 68) 4-$CH_3$-5-$C_6H_5$—
69) 4-$C_6H_5$-5-$CH_3$—
70) 4-$C_2H_5$-5-$C_6H_5$—
71) 4-$CH_3$-5-(p-$CH_3C_6H_4$—)
72) 4-$CH_3$-5-(p-$ClC_6H_4$—)
73) 4-$CH_3$-5-(p-$BrC_6H_4$—)
74) 4-$CH_3$-5-(p-$IC_6H_4$—)
75) 4-$CH_3$-5-(o-$CH_3OC_6H_4$—)
76) 4-$CH_3$-5-(p-$CH_3OC_6H_4$—)
77) 4-(p-$CH_3OC_6H_4$—)-5-$CH_3$—
78) 4-$CH_3$-5-[2,4-$(CH_3)_2C_6H_3$—]
79) 4-$CH_3$-5-[2,5-$(CH_3)_2C_6H_3$—]
80) 4-$CH_3$-5-[3,4-$(CH_3)_2C_6H_3$—]
81) 4-$CH_3$-5-(4-$CH_3O$-3-$(CH_3C_6H_3$—)
82) 4-$CH_3$-5-(2$CH_3O$-4-$CH_3C_6H_3$—)
83) 4-$CH_3$-5-(2-$CH_3O$-5-$CH_3C_6H_3$—)
84) 4-$CH_3$-5-(2-$CH_3S$-5-$CH_3C_6H_3$—)
85) 4-$CH_3$-5-(2-HO-3-$CH_3OC_6H_3$—)
86) 4-$CH_3$-5-[2,4-$(CH_3O)_2C_6H_3$—]
88) 4-$CH_3$-5-[3,4-$(CH_3O)_2C_6H_3$—]
89) 4-$CH_3$-5-[2,4,6-$(CH_3)_3C_6H_2$—]
90) 4-(1-Naphthyl-)-5-$CH_3$—
91) 4-(1-Naphthyl-)-5-$C_2H_5$—
92) 4-$CH_3$-5-(2-$CH_3O$-1-naphthyl-)
93) 4-$CH_3$-5-(2-thienyl-)
94) 4-(2-Thienyl-)-5-$CH_3$—
95) 4-(5-$CH_3$-2-thienyl-)-5-$CH_3$—
96) 4-$CH_3$-5-(5-$CH_3$-2-thienyl-)
97) 4-$C_2H_5$-5-(5-$CH_3$-2-thienyl-)
98) 4-(5-$C_2H_5$-2-thienyl-)-5-$CH_3$—
99) 4-$CH_3$-5-(5-$C_2H_5$-2-thienyl-)
100) 4-$C_2H_5$-5-(5-$C_2H_5$-2-thienyl-)
101) 4-$CH_3$-5-[4,5-$(CH_3)_2$-2-thienyl-]
102) 4-$CH_3$-5-(3-pyridyl-)
103) 4-$C_2H_5$-5-(3-pyridyl-)
104) 4-n-$C_4H_9$-5-(3-pyridyl-)
105) 4-$CH_3$-3-(4-pyridyl-)
106) 4-$C_2H_5$-5-(4-pyridyl-)
107) 4-$C_2H_5$-5-($C_6H_5C$=CH—)
108) 4-$CH_3$-5-(p-$CH_3OC_6H_4CH$=CH—)
109) 4-$C_2H_5$-5-(p-$CH_3OC_6H_4CH$=CH—)
110) 4-(-n-$C_3H_7$—)-5-(p-$CH_3OC_6H_4C$=CH—)
111) 4-$C_2H_5$-5-(2-furyl-CH=CH—)
112) 4-(n-$C_3H_7$—)-5-(2-furyl-CH=CH—)
113) 4-$C_6H_5$-5-$C_6H_5CH_2$—
114) 4-($C_6H_5CO$—)-5-$C_6H_5$—
115) 4-($C_6H_5CS$—)-5-$C_6H_5$—
116) 4,5-$(C_6H_5—)_2$
117) 4-(p-$CH_3OC_6H_4$—)-5-$C_6H_5$—
118) 4-(p-$HOC_6H_4$—)-5-$C_6H_5$—
119) 4-(p-$CH_3CO_2C_6H_4$—)-5-$C_6H_5$—
120) 4-$C_6H_5$-5-(2-$CH_3O$-5-$CH_3C_6H_3$—)
121) 4,5-(p-$CH_3OC_6H_4$—)$_2$
122) 4-[2,4-$(CH_3O)_2C_6H_3$—-5-$C_6H_5$—]
123) 4-(3-$HO_3S$-4-$CH_3OC_6H_3$—) -5-$C_6H_5$—
124) 4-(3-$ClO_2S$-4-$CH_3OC_6H_3$—)-5-$CH_6H_5$—
125) 4-(3-$C_2H_5O_3S$-4-$CH_3OC_6H_3$—)-5-$C_6H_5$—
126) 4-(3-$C_6H_5NHO_2S$-4-$CH_3OC_6H_3$—)-5-$C_6H_5$—
127) 4-(3-$CH_3Co$-4-$CH_3OC_6H_3$—)-5-$C_6H_5$—
128) 4-(3-$C_2H_5CO$-4-$CH_3OC_6H_3$—)-5-$C_6H_5$—
129) 4-$C_6H_5$-5-(3-pyridyl-)
130) 4-$C_6H_5$-5-(4-pyridyl-)
131) 4-$C_6H_5$-5-(2-furyl-CH=CH—)
132) 4-$CH_3$-5-$CH_3O_2C$—
133) 4-$CH_3O_2C$-5-$C_6H_5$—
134) 4-$C_2H_5O_2C$-5-$C_6H_5$—
135) 4-$C_6H_5$-5-$CH_3O_2C$—
136) 4-$CH_3$-5-[p-$(CH_3)_2NO_6H_4N$=CH—]
137) 4-$C_2H_5$-5-[p-$(CH_3)_2NC_6H_4N$=CH—]
138) 4-(n-$C_3H_7$—)-5-[p-$(CH_3)_2NO_6H_4N$=CH—]
139) 4-$C_6H_5$-5-[p-$(CH_3)_2NC_6H_4N$=CH—]
140) 4-$CH_3$-5-[p-$(CH_3)_2NC_6H_4N$=CH—]
O
141) 4-$C_2H_5$-5-[p-$(CH_3)_2NC_6H_4N$=CH—]
O
142) 4-(n-$C_3H_7$—)-5-[p-$CH_3)_2NC_6H_4N$=CH—]
O
143) 4-$C_6H_5$-5-[p-$(CH_3)_2NC_6H_4N$=CH—]
O
144) 4-HS-5-$C_6H_5$—
145) 4-HS-5-(p-$CH_3OC_6H_4$—)
146) 4-$CH_3S$-5-$C_6H_5$—
147) 4-$CH_3S$-5-(p-$CH_3OC_6H_4$—)
148) 4-$CH_3COS$-5-$C_6H_5$—
149) 4-$CH_3COS$-5-(p-$CH_3OC_6H_4$—)
150) 4-$C_6H_5COS$-5-$C_6H_5$—
151) 4-$C_6H_5COS$-5-(p-$CH_3OC_6H_4$—)
152) 4-$CH_3O$-5-$C_6H_5$—

Few, if any, of commercial antifoulants now sold are capable of effectively inhibiting fouling in high temperature process heater, i.e., above about 500° F., such as from about 500°-1500° F., for example, from about 500° to 1200° F., but preferably from about 800° F. to 1000° F.

One example of a high temperature fouling occurs in delayed coking operations of petroleum refining. This is best illustrated by fouling occurring in the coker furnace and in the long transfer line between the coker furnace and the coke drums. Such "coke" buildup requires periodic cleaning (decoking) of such lines, during which operation of the unit is curtailed.

The coker in a refinery relates to the collection of bottoms from the refinery operation, the heating of such bottoms in the coking furnace to high temperature of about 900° F. or higher so as to remove and collect the volatile fractions and the transportation through pipe conduits to coke drums for later use, for example, as high grade coke, etc. The bottoms pass through heat exchange conduits in the coking furnace and then through conduits to the coke drums where they are collected. In going through the conduits, fouling occurs through a buildup by adhesion of deposits on the inside of the conduits resulting in pressure buildup and loss of heat transfer efficiency due to the smaller diameters of the fouled conduits. When the pressure buildup becomes sufficiently great, the conduits have to be cleaned (decoked).

The following examples are presented for purposes of illustration and not of limitation.

EXAMPLE 1

A Midwestern refinery experienced severe fouling in the long transfer line between coke furnace and coke drums. Once deposits began, pressure at the beginning of the line increased rapidly and the lines had to be decoked when the pressure reached 200 psi. This occurred over a period of about 90 days.

After decoking was effected, the composition of the formula (Ex. 3A)

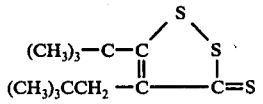

was injected at about 20 ppm into the coker furnace feed. After about 100 days the additive concentration was reduced by ⅓ and kept at this concentration. No pressure buildup occurred through the coking furnace has been in operation over a period of many months. Typical operating conditions are as follows:

| | |
|---|---|
| Charge | 4400 B/D |
| Cycle | 24 hours |
| Coke Type | Regular and Needle |
| Furnace Inlet Temp. | 580-600° F |

-continued

| | |
|---|---|
| Furnace Outlet Temp. | |
| Regular Coke | 925° F |
| Needle Coke | 945° F |
| Coke Drum Pressure | 20 psi |

EXAMPLE 2

A typical furnace fouling problem occurred in a delayed coker even though a commercial antifoulant was injected into the furnace charge at 24 ppm. Three months into a run, the pressure drop across the furnace had reached 290 psi. A pressure drop of 320 psi is considered limiting and necessitates a decoking operation. At this point the commercial antifoulant was replaced with the compound of Example 3A at 8 ppm and the pressure drop lined out at 295 psi without further increase.

Typical operating conditions are as follows:

| | |
|---|---|
| Charge | 5000 B/D |
| Furnace Inlet Temp. | 680° F. |
| Furnace Outlet Temp.: | |
| Regular Coke | 912° F. |
| Needle Coke | 945° F. |
| Furnace Pressure clean | 210 psi |
| Furnace Pressure fouled | 320 psi |

We claim:

1. A process of inhibiting the adhesion of deposits from hydrocarbons on metallic surfaces of the treating apparatus when said hydrocarbons are treated at elevated temperatures of from about 500° F. to about 1500° F. which comprises adding to said hydrocarbons during the treatment process an inhibiting amount of a heterocyclic organo-sulfur compound of high sulfur content having the formula

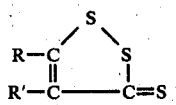

where R and R' which may be the same or different are hydrogen or a substituted group.

2. The process of claim 1 where the organo-sulfur compound has at least 5% sulfur.

3. The process of claim 2 where the organo-sulfur compound has from about 25% to 45% sulfur.

4. The process of claim 1 where the organo-sulfur compound is present in an amount of at least 0.5 p.p.m. in the hydrocarbon liquid.

5. The process of claim 1 where the organo-sulfur compound is

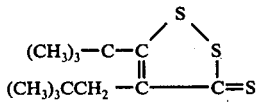

* * * * *